United States Patent [19]

Riedhammer

[11] Patent Number: 5,046,403

[45] Date of Patent: Sep. 10, 1991

[54] AXIAL PISTON MACHINE WITH SWASH PLATE CONSTRUCTION

[75] Inventor: Josef Riedhammer, Horb am Neckar, Fed. Rep. of Germany

[73] Assignee: Linde Aktiengesellschaft, Fed. Rep. of Germany

[21] Appl. No.: 573,848

[22] Filed: Aug. 28, 1990

[30] Foreign Application Priority Data

Aug. 31, 1989 [DE] Fed. Rep. of Germany ..... 3928942

[51] Int. Cl.[5] ..... F01B 13/04

[52] U.S. Cl. ..... 92/57; 92/71; 91/472; 91/499; 74/60

[58] Field of Search ..... 92/12.2, 57, 71; 417/269, 222; 91/472, 499, 504, 505, 506; 74/60

[56] References Cited

U.S. PATENT DOCUMENTS

| | | | |
|---|---|---|---|
| 2,691,350 | 10/1954 | Greer | 91/501 |
| 2,699,123 | 1/1955 | Bonnette et al. | 91/505 |
| 3,265,008 | 8/1966 | Ward | 91/490 |
| 3,382,814 | 5/1968 | Pinkerton | 91/499 |
| 3,611,879 | 10/1971 | Alderson | 91/507 |
| 3,641,829 | 2/1972 | Reynolds | 74/60 |
| 4,568,252 | 2/1986 | Hattori et al. | 92/71 |

FOREIGN PATENT DOCUMENTS

| | | | |
|---|---|---|---|
| 2124644 | 3/1979 | Fed. Rep. of Germany | 91/499 |
| 3222210 | 12/1983 | Fed. Rep. of Germany . | |
| 0035280 | 11/1965 | German Democratic Rep. | 92/71 |
| 1198246 | 12/1985 | U.S.S.R. | 91/499 |

*Primary Examiner*—Edward K. Look

*Assistant Examiner*—Thomas Denion

*Attorney, Agent, or Firm*—Webb, Burden, Ziesenheim & Webb

[57] ABSTRACT

An axial piston machine has a housing with a cover, a swash plate located within the housing and an elongated rotary shaft extending through the swash plate and the housing with an end in the housing cover. A cylindrical drum is connected to the shaft for rotation therewith and one end of the cylindrical drum abuts against a surface of a control member located in the housing adjacent to the housing cover. A number of concentrically arranged cylindrical passages are formed in the cylindrical drum and a longitudinally moveable hollow piston is located in each cylindrical passage. A slide shoe is located at one end of each piston and each slide shoe is in working connection with the swash plate. Each slide shoe has a slide shoe plate, a slide shoe neck and a slide shoe head connected to one of the pistons. The face of each slide shoe plate which is opposed to the swash plate is in contact with an annular, spring-loaded retaining plate which is provided with a number of concentrically arranged recesses. The number and spacing of the recesses correspond with the number and spacing of the cylindrical passages in the cylindrical drum in order to receive the slide shoe neck. The faces of the slide shoe plates which face the swash plate are supported on an annular sliding disk which is connected to the annular sliding disk and the retaining plate in order to rotate along with the annular sliding disk and the retaining plate.

21 Claims, 3 Drawing Sheets

AXIAL PISTON MACHINE WITH SWASH PLATE CONSTRUCTION

BACKGROUND OF THE INVENTION

1. Field of the Invention

The invention is directed generally to an axial piston machine having a swash plate construction with a cylindrical drum that is connected to a shaft. The shaft passes through the swash plate and is supported on one end against a control surface. The drum has a number of concentrically located elongated cylindrical passages formed therein and each passage has a longitudinally moveable piston therein. Each piston is provided at one end with a sliding shoe that is in working connection with the swash plate and which has a sliding shoe plate and a sliding shoe neck. The faces of the sliding shoe plates opposite from the swash plate contact an annular spring-loaded hold-down plate that is provided with concentrically located recesses corresponding in number and spacing with the cylindrical passages in the cylindrical drum to receive the sliding shoe necks.

2. Description of Related Prior Art

An axial piston machine generally in accordance with the above description is known from German Patent No. DE 3222210. The hold-down plate described therein is spring-loaded and prevents the slide shoes from rising under the action of the inertial forces and the suction forces of the swash plate on the piston during rotation of the cylindrical drum. The spring force is designed to handle the maximum forces that arise during operation of the machine, but the force also operates in normal operation with lower loads. Thus, during normal operation there is the disadvantage of high friction between the slide shoes and the swash plate and this is especially true when a machine starts from a dead stop. In order to eliminate this shortcoming, the above-referenced patent suggests that the hold-down or retaining plate or at least the annular portion thereof acts on the latter with a spring action against a stop connected with the drive shaft. This arrangement results in the force of the spring being transferred to the stop rather than to the slide shoe, at least when the machine is stopped. The spring is to act on the slide shoe through the annular part and the retaining plate and prevent it from rising further only when the slide shoe rises past a predetermined degree. In order to assure proper functioning of an axial piston machine designed in this manner, it is necessary to maintain very precise tolerances in the production and assembly of the elements.

SUMMARY OF THE INVENTION

The invention is the above type of axial piston machine having an improved working connection between the slide shoes and the swash plate.

The problem is solved according to the invention by supporting the faces of the slide shoe plates which face the swash plate on an annular sliding disk that is connected with the retaining plate and is rotatably supported against the swash plate. In this arrangement, a single sliding plate rotates on the swash plate instead of a plurality of slide shoes and the point loading of the swash plate by individual slide shoes is converted into a uniform loading through the annular surface. For this reason, the slide shoe does not tilt when the machine is started. Despite the spring-loading in the stopped state, a hydrostatic film of lubricant can be built up very rapidly between the sliding disk and the swash plate.

This buildup is facilitated because the spring-loading can be maintained smaller. The pistons that are under a high pressure during the operation of the machine exert a reaction force on the sliding disk and thus also on the retaining plate connected to it for the swash plate and this force counteracts the inertial forces and the piston suction forces of the pistons that are not under high pressure, i.e., through the sliding disk.

Due to the inclination of the swash plate and the eccentricity of the sliding disk induced by it, it is necessary to allow a slight relative movement between the slide shoe and the sliding disk. Due to this slight relative movement and as a result of the form-locking envelopment of the slide shoe, tilting of the slide shoe is prevented. It is also unnecessary to make the running surface of the slide shoe from a bearing material. It is sufficient, according to a preferred embodiment of the invention, to produce the slide shoe entirely of hardened steel and allow it to run against a hardened countersurface on the sliding disk. In order to facilitate the connection of the sliding disk and the retaining plate with slide shoes located between them in the simplest possible manner, the invention provides a spacing disk located between the sliding disk and the retaining plate. The thickness of the spacing disk substantially corresponds to the thickness of the slide shoe plates and the disk is provided with recesses corresponding in number and spacing with the cylindrical passages in the cylindrical drum for receiving the slide shoe plates, in which case the dimensions of the recesses facilitate relative movement of the slide shoe on the sliding disk. The sliding disk, the spacing disk and the retaining plate can be economically produced and assembly is very simple as the parts may be bolted or riveted together.

However, it is also possible to connect these parts by a flanging, as well known to those skilled in the art. Flanging the spacing disk on the outer edge with regard to both the retaining plate and the sliding disk results in both the retaining plate and the sliding disk being enveloped and retained.

In another embodiment of the invention, the side of the retaining plate facing the sliding disk is provided with axial recesses that correspond in number and spacing to the cylindrical passages in the cylindrical drum. The recesses are provided for receiving the slide shoe plates. In this case the dimensions of the recesses facilitate relative movements of the slide shoe on the sliding disk. The spacing disk is thus integrated into the retaining plate, which reduces the number of individual components.

It is advantageous, according to another embodiment of the invention, if the side of the sliding disk facing the swash plate has a shaped annular contact surface, the width of which is smaller than the diameter of a slide shoe plate. The diameter of the swash plate can be substantially reduced while maintaining the diameter of the slide shoe plates. The weight and dimensions of the axial piston machine are also reduced. In an axial piston machine in which the swash plate is adjustable, the adjusting speed can be increased due to the smaller inertial forces and the dynamic behavior of the machine is improved.

It is advantageous to provide the contact surface of the sliding disk with hydrostatic relief grooves corresponding to the number of slide shoes. In such an arrangement a relief groove is connected through channels in the assigned slide shoe and piston with the assigned cylindrical passage. Depending on the piston forces actually present, both the sliding disk and the slide shoe are hydrostatically relieved.

In another embodiment of the invention a calotte-shaped spring-loaded annular body is longitudinally displaceable along the shaft and projects at least partially into a recess of the swash plate and is supported against the inner surface of the centric recess of the sliding disk and/or the spacing disk and/or the retaining plate, possibly with the use of an intermediate sleeve. Thus, each of the components can take up the spring force and the axial dimension of the machine is reduced through at least partial projection of the calotte-shaped annular body into the recess of the swash plate.

The features which characterize the invention are pointed out with particularity in the claims annexed to and forming a part of this disclosure. For a better understanding of the invention, its operating advantages and the specific objects attained by its use, reference should be had to the accompanying drawings and descriptive matter in which a preferred embodiment of the invention is illustrated and described. Like reference characters describe like parts throughout the drawings.

DESCRIPTION OF THE PREFERRED EMBODIMENTS

Figure 1:
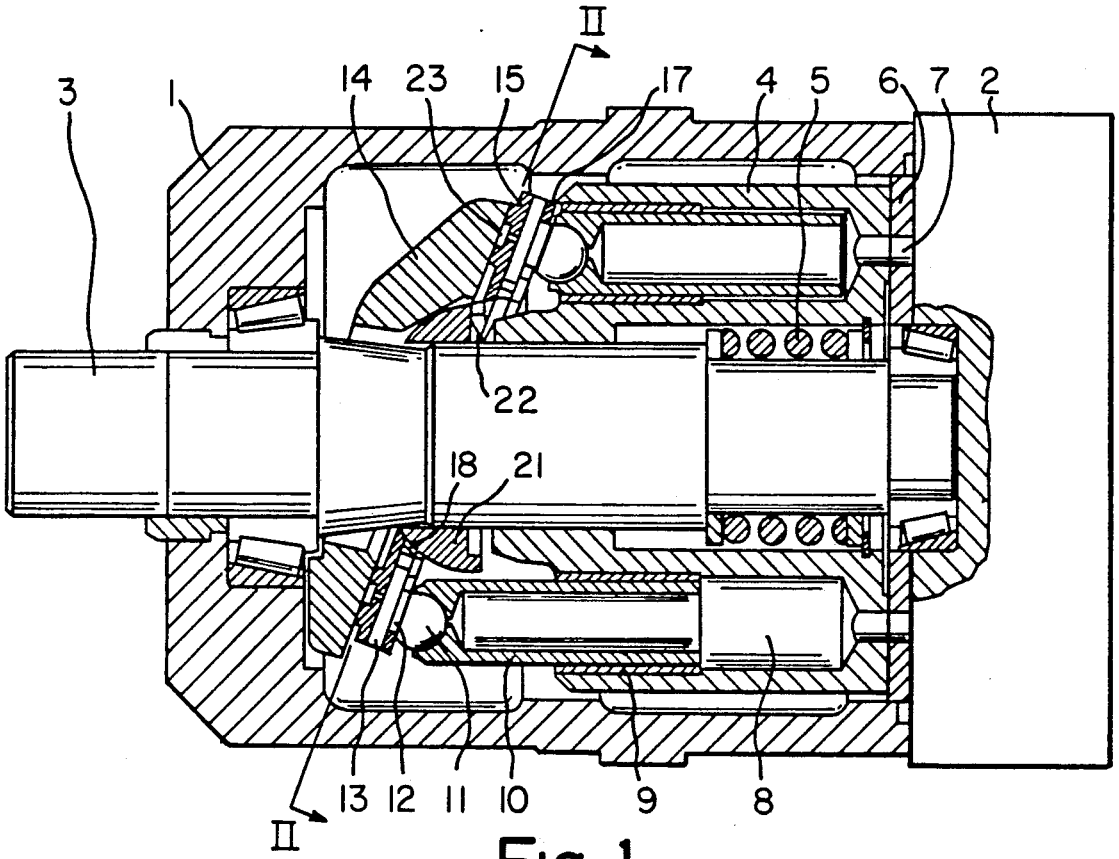
FIG. 1 is a longitudinal section through an axial piston machine according to the invention.
Figure 2:
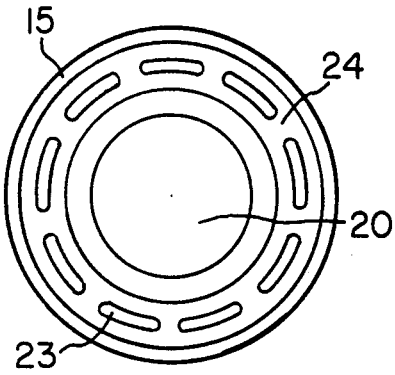
FIG. 2. is a plan view of a sliding disk in the direction of line II—II in FIG. 1.
Figure 3:
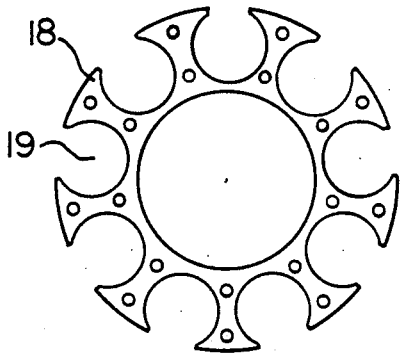
FIG. 3 is a plan view of a spacing disk according to the invention.
Figure 4:
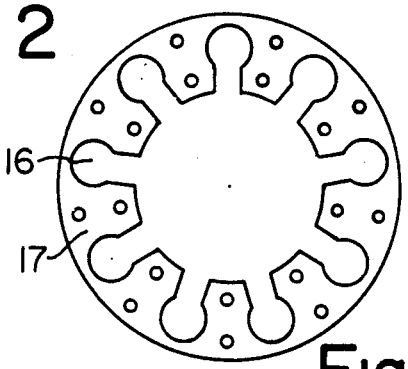
FIG. 4 is a plan view of a retaining plate according to the invention.

With reference to FIG. 1 of the drawings it will be seen that the axial piston machine has a housing 1 with a housing cover 2 at the open end. A drive or driven shaft 3 is supported in housing 1 and housing cover 2 and can operate as either a pump (driven) or a motor (drive). A cylindrical drum 4 is connected to shaft 3 for rotation with the shaft 3, e.g., by means of a spline, and can reciprocate along shaft 3. A helical spring 5 presses cylindrical drum 4 against the surface of a control member 6 fixed to housing 1 adjacent to housing cover 2. Control member 6 is provided with a plurality of control channels 7. The cylindrical drum 4 has a plurality of concentrically arranged cylindrical passages 8 with sliding sleeves 9 in which preferably hollow pistons 10 are longitudinally moveable. The end of each piston 10 opposite control member 6 is provided with a hollow-spherical recess in which a spherical slide shoe head 11 is located and which together with a slide shoe neck 12 and a slide shoe plate 13 form a slide shoe. Each slide shoe is in working connection with swash plate 14 and shaft 3 passes through the swash plate. Swash plate 14 is adjustable, as shown in the present example, but the adjusting mechanism is not shown. The swash plate 14 shown in FIG. 1 of the drawings has a rolling motion during adjustment and the swash plate can be held flat.

In prior art axial piston machines the slide shoe plates 13 of the slide shoes slide directly on swash plate 14 and if the swash plate is substantially vertical relative to the drive axis of the machine a piston stroke does not take place and slide shoe plates 13 move on a circular slide path on the swash plate when the drive shaft rotates. When the swash plate 14 is swung out at an angle to the vertical, an elliptical slide path of the slide shoe plates on the swash plate 14 results due to the inclination. The slide shoes are pressed against the swash plate 14 by a spring-loaded retaining device to prevent the slide shoes from rising as a result of inertial forces and the suction forces of the piston 10. Considerable friction results between the slide shoe plates 13 and the swash plate 14 and this friction reduces the efficiency of the axial piston machine. The friction is very high especially when the machine is started; and consequently, there is the danger of the slide shoes tilting, which causes poor starting behavior due to the accompanying stick-slip effect. For this reason hydrostatic relief of slide shoe plates 13 is provided to counteract the spring loading, by which a specific required slide shoe diameter and a specific outside diameter of swash plate 14 are adopted so that a hydrostatic relief takes place at any point on the elliptical slide path.

With reference to FIGS. 1-6 of the drawings, the axial piston machine according to the invention has an annular sliding disk 15 located between the slide shoe plates 13 of the slide shoes and swash plate 14. The slide shoe necks 12 of the slide shoes are located in recesses 16 formed in an annular retaining plate 17, as is known in the prior art. The annular retaining plate 17 is connected to sliding disk 15 by bolts, rivets or other suitable connecting means. An annular spacing disk 18 is located between retaining plate 17 and sliding disk 15. The thickness of annular spacing disk 18 is essentially the same as the thickness of slide shoe plates 13 and has recesses 19 formed therein for slide shoe plates 13.

Both the recesses 16 in retaining plate 17 for the slide shoe necks 12 and the recesses 19 in spacing disk 18 for slide shoe plates 13 facilitate movement of the slide shoes on sliding disk 15 for compensation of the eccentricities of sliding disk 15 which are caused by the different inclinations of swash plate 14. Due to the connection between sliding disk 15 and retaining plate 17 and the envelopment of the slide shoes by spacing disk 18 and retaining plate 17, there is only a slight relative movement of the slide shoes on sliding disk 15 in the peripheral direction, i.e., the sliding disk 15 affects the principal movement in the peripheral direction on swash plate 14. The slide shoes are thus prevented from tilting. Because of the small relative movement of the slide shoes on sliding disk 15, the slide shoes can be made entirely of hardened steel instead of a bearing material and can run against a hardened countersurface on sliding disk 15.

The wall of central recess 20 in sliding disk 15 has a spherical surface that is supported against a calotte-shaped spring-loaded annular body 21 that is longitudinally moveable on shaft 3 and projects at least partially into a recess in swash plate 14. The spring loading is caused by plate springs 22 that are supported on cylinder drum 4. The force applied to annular body 21 by plate springs 22 is great enough to press the sliding disk, the spacing disk, the retaining plate, the slide shoes and the pistons against swash plate 14 even in the case of large inertial forces and piston suction forces.

The retaining device according to the invention results in another essential advantage because plate springs 22 can be made relatively weak and this reduces frictional force on the swash plate. The reason for this is that hollow pistons 10 are under high pressure and exert a reaction force on sliding disk 15 and thus also on retaining plate 18 toward swash plate 14. The pistons that exert suction forces or act on the inertial forces directed away from swash plate 14 are thus pressed toward swash plate 14 by retaining plate 17.

In order to further reduce the friction of the relative movement of sliding disk 15 on swash plate 14 and of slide shoe plates 13 on sliding disk 15, the cylindrical passages 8 are connected through the hollow piston interior and channels (not shown) in the slide shoes with hydrostatic relief grooves 23 which are provided on the side of sliding disk 15 facing swash plate 14. The slide shoe plates 13 are also hydrostatically relieved through these channels on the side facing the swash plate.

The side of sliding disk 15 which faces swash plate 14 is provided with a shaped annular running surface 24 having a width smaller than the diameter of slide shoe plates 13. Nevertheless, the surface of running surface 24 which is available for hydrostatic relief is essentially just as large as the sum of the individual surfaces of slide shoe plates 13. The swash plate can thus be made smaller with the hydrostatic relief remaining the same which reduces the dimensions and the weight of the axial piston machine. Additionally, swash plate 14 can be swung more rapidly due to the smaller inertial forces.

Figure 5:
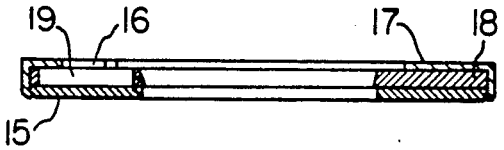
FIG. 5 is a section on line V—V of FIG. 6.
Figure 6:
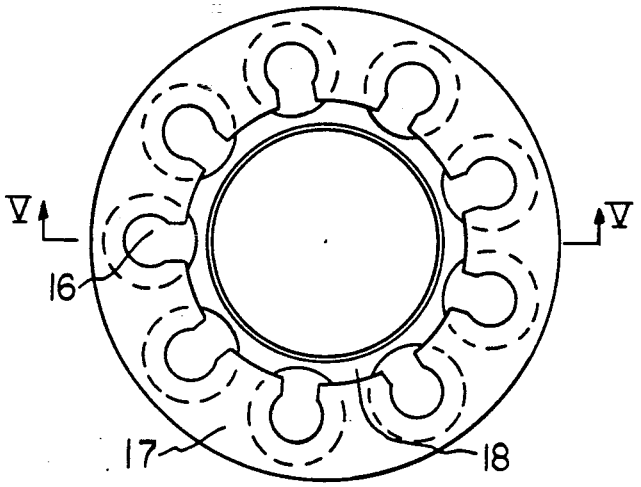
FIG. 6 is a plan view of the retaining plate shown in FIG. 5.

FIGS. 5 and 6 of the drawings show the connection between retaining plate 17, spacing disk 18 and sliding disk 15 by a flanging arrangement. The outer edge of the retaining plate 17 envelopes and retains the outer edges of spacing disk 18 and sliding disk 15. The production and assembly is simplified by the flanging arrangement because no connecting bolts or rivets are necessary.

Figure 7:
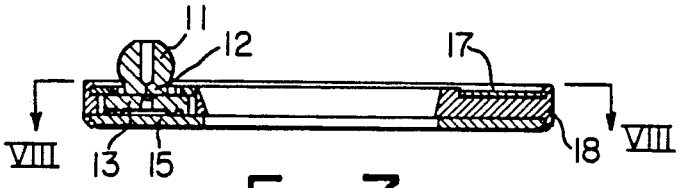
FIG. 7 is a section on line VII—VII of FIG. 8.
Figure 8:
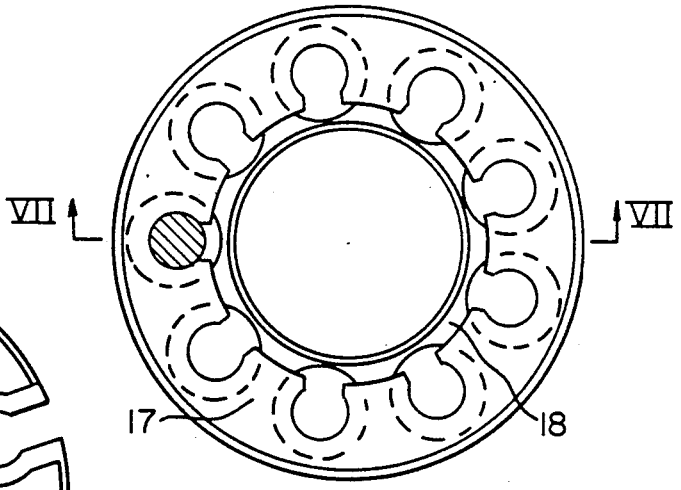
FIG. 8 is a section on line VIII—VIII of FIG. 7.

In the embodiment shown in FIGS. 7 and 8 of the drawings, the outer edge of spacing disk 18 envelopes and retains both the retaining plate 17 and the sliding disk 15 on the outer diameter.

Figure 9:
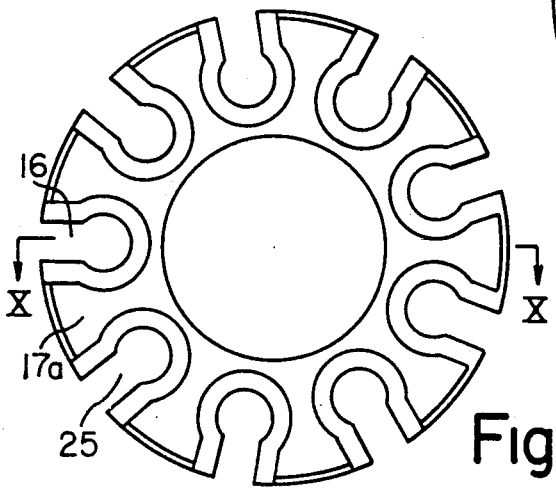
FIG. 9 is a plan view of a retaining plate according to another embodiment of the invention.
Figure 10:
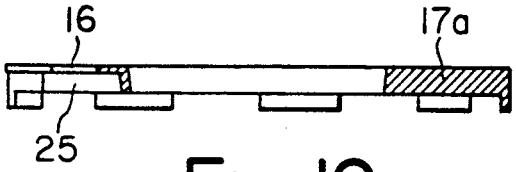
FIG. 10 is a section on line X—X of FIG. 9.
Figure 11:
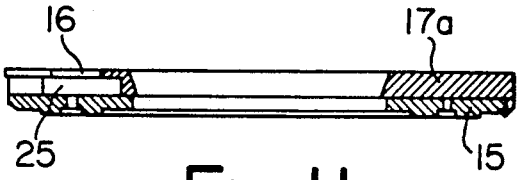
FIG. 11 is a modified section including a sliding disk on line X—X of FIG. 9.

In the embodiment shown in FIGS. 9–11 of the drawings, the spacing disk is formed as a part of a retaining plate 17*a*. For this purpose, retaining plate 17*a* has axial recesses 25 for receiving the slide shoe plates. The connection between retaining plate 17*a* and sliding disk 15 is by a flanging arrangement of the outer edge of retaining plate 17*a*. The number of individual components is reduced in this embodiment.

Figure 13:
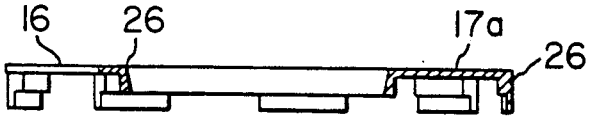
FIG. 13 is a section on line XIII—XIII of FIG. 12.
Figure 14:
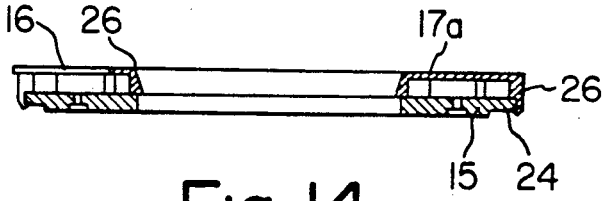
FIG. 14 is a modified section including a sliding disk on line XIII—XIII of FIG. 12.
Figure 12:
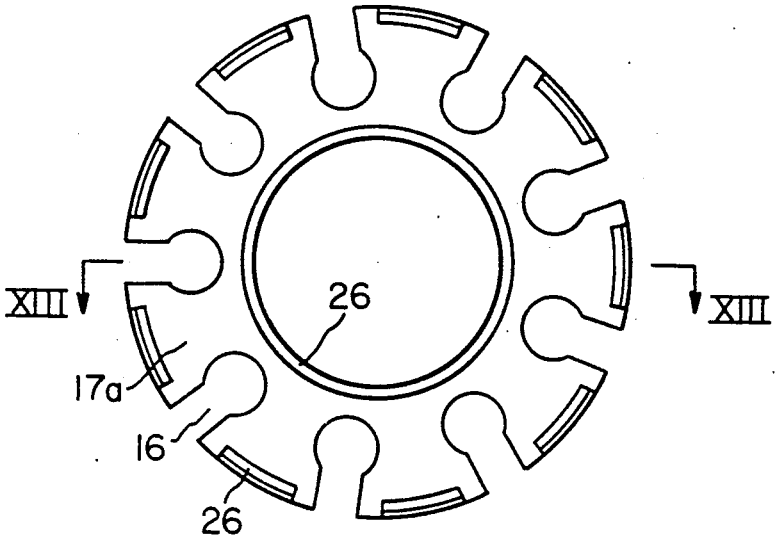
FIG. 12 is a plan view of retaining plate according to another embodiment of the invention.

The embodiment shown in FIGS. 12–14 of the drawings is similar to that shown in FIGS. 9–11 of the drawings, except that the function of the spacing disk is performed by axial protrusions 26 extending from the inner surface of retaining plate 17*a*. The connection with the sliding disk 15 is also formed by a flanging arrangement.

The foregoing describes a preferred embodiment of the invention and is given by way of example only. The invention is not limited to any of the specific features described herein, but includes all such variations thereof within the scope of the appended claims.

I claim:

1. An axial piston machine having a housing, a housing cover, a swash plate, an elongated rotary shaft extending through said swash plate and said housing with an end in said housing cover and a cylindrical drum connected to said shaft for rotation therewith, said cylindrical drum abutting against a surface of a control member located in said housing adjacent to said housing cover and a plurality of concentrically arranged cylindrical passages formed in said cylindrical drum, a longitudinally moveable piston located in each of said cylindrical passages, a slide shoe at one end of each of said pistons, each of said slide shoes being in working connection with said swash plate, each of said slide shoes having a slide shoe plate, a slide shoe neck and a slide shoe head connecting with one of said pistons, the faces of said slide shoe plates opposite from said swash plate being in contact with an annular, spring-loaded retaining plate, said retaining plate being provided with a plurality of concentrically arranged recesses corresponding in number and spacing to the number and spacing of said cylindrical passages in said cylindrical drum to receive said slide shoe necks, said faces of said slide shoe plates facing said swash plate being supported on an annular sliding disk, means connecting said annular sliding disk and said retaining plate for rotation of said annular sliding disk and said retaining plate relative to said swash plate.

2. An axial piston machine as set forth in claim 1, wherein said slide shoes are made from a hardened steel and are supported on a hardened surface of said sliding disk.

3. An axial piston machine as set forth in claim 1, wherein a spacing disk having a thickness substantially the same as the thickness of said slide shoe plates is provided between said sliding disk and said retaining plate, said spacing disk having recesses formed therein for said slide shoe plates which correspond in number and spacing with said cylindrical passages in said cylindrical drum, the dimensions of said recesses facilitating relative movements of said slide shoes on said sliding disk.

4. An axial piston machine as set forth in claim 2, wherein a spacing disk having a thickness substantially the same as the thickness of said slide shoe plates is provided between said sliding disk and said retaining plate, said spacing disk having recesses formed therein for said slide shoe plates which correspond in number and spacing with said cylindrical passages in said cylindrical drum, the dimensions of said recesses facilitating relative movements of said slide shoes on said sliding disk.

5. An axial piston machine as set forth in claim 3, wherein said sliding disk is bolted or riveted to said spacing disk and said retaining plate.

6. An axial piston machine as set forth in claim 4, wherein said sliding disk is bolted or riveted to said spacing disk and said retaining plate.

7. An axial piston machine as set forth in claim 3, wherein said sliding disk is flanged to said spacing disk and said retaining plate.

8. An axial piston machine as set forth in claim 4, wherein said sliding disk is flanged to said spacing disk and said retaining plate.

9. An axial piston machine according to claim 1, wherein the side of said retaining plate facing said sliding disk is provided with axial recesses corresponding in number and spacing to said cylindrical passages in said cylindrical drum for receiving said slide shoe plates, the dimensions of said recesses facilitating relative movements of said slide shoes on said sliding disk.

10. An axial piston machine according to claim 2, wherein the side of said retaining plate facing said sliding disk is provided with axial recesses corresponding in number and spacing to said cylindrical passages in said cylindrical drum for receiving said slide shoe plates, the dimensions of said recesses facilitating relative movements of said slide shoes on said sliding disk.

11. An axial piston machine as set forth in claim wherein the side of said sliding disk facing said swash plate has a shaped annular running surface having a width smaller than the diameter of one of said slide shoe plates.

12. An axial piston machine as set forth in claim 3, wherein the side of said sliding disk facing said swash plate has a shaped annular running surface having a width smaller than the diameter of one of said slide shoe plates.

13. An axial piston machine as set forth in claim 5, wherein the side of said sliding disk facing said swash plate has a shaped annular running surface having a width smaller than the diameter of one of said slide shoe plates.

14. An axial piston machine as set forth in claim 7, wherein the side of said sliding disk facing said swash plate has a shaped annular running surface having a width smaller than the diameter of one of said slide shoe plates.

15. An axial piston machine as set forth in claim 9, wherein the side of said sliding disk facing said swash plate has a shaped annular running surface having a width smaller than the diameter of one of said slide shoe plates.

16. An axial piston machine as set forth in claim 1, wherein said annular running surface of said sliding disk is provided with hydrostatic relief grooves corresponding in number to the number of said slide shoes, and a channel connecting each of said relief grooves through the assigned slide shoe and longitudinally moveable piston with the assigned cylindrical passage in said cylindrical drum.

17. An axial piston machine as set forth in claim 12, wherein said annular running surface of said sliding disk is provided with hydrostatic relief grooves corresponding in number to the number of said slide shoes, and a channel connecting each of said relief grooves through the assigned slide shoe and longitudinally moveable piston with the assigned cylindrical passage in said cylindrical drum.

18. An axial piston machine as set forth in claim 14, wherein said annular running surface of said sliding disk is provided with hydrostatic relief grooves corresponding in number to the number of said slide shoes, and a channel connecting each of said relief grooves through the assigned slide shoe and longitudinally moveable piston with the assigned cylindrical passage in said cylindrical drum.

19. An axial piston machine as set forth in claim 1, including a calotte-shaped spring-loaded annular body supported on said shaft for longitudinal movement, said annular body projecting at least partially into a recess in said swash plate and supported against the inner surface of the centric recess in said sliding disk and said spacing disk and said retaining plate by an intermediate sleeve.

20. An axial piston machine as set forth in claim 3, including a calotte-shaped spring-loaded annular body supported on said shaft for longitudinal movement, said annular body projecting at least partially into a recess in said swash plate and supported against the inner surface of the centric recess in said sliding disk and said spacing disk and said retaining plate by an intermediate sleeve.

21. An axial piston machine as set forth in claim 7, including a calotte-shaped spring-loaded annular body supported on said shaft for longitudinal movement, said annular body projecting at least partially into a recess in said swash plate and supported against the inner surface of the centric recess in said sliding disk and said spacing disk and said retaining plate by an intermediate sleeve.

* * * * *

UNITED STATES PATENT AND TRADEMARK OFFICE

CERTIFICATE OF CORRECTION

PATENT NO. : 5,046,403

DATED : September 10, 1991

INVENTOR(S) : Josef Riedhammer

It is certified that error appears in the above-identified patent and that said Letters Patent is hereby corrected as shown below:

Claim 11 Line 13 Column 7 after "claim" insert --1,--.

Claim 16 Line 38 Column 7 "1," should read --11,--.

Signed and Sealed this

Twelfth Day of January, 1993

*Attest:*

DOUGLAS B. COMER

*Attesting Officer*

*Acting Commissioner of Patents and Trademarks*